US011622202B2

(12) United States Patent
Kervran et al.

(10) Patent No.: US 11,622,202 B2
(45) Date of Patent: Apr. 4, 2023

(54) COMB-LIKE CAPACITIVE MICROPHONE

(71) Applicant: AAC ACOUSTIC TECHNOLOGIES (SHENZHEN) CO., LTD., Shenzhen (CN)

(72) Inventors: Yannick Pierre Kervran, HK (FR); Rui Zhang, Shenzhen (CN)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/341,412

(22) Filed: Jun. 8, 2021

(65) Prior Publication Data

US 2022/0394393 A1 Dec. 8, 2022

(51) Int. Cl.
*H04R 9/08* (2006.01)
*H04R 1/08* (2006.01)

(52) U.S. Cl.
CPC ..... *H04R 9/08* (2013.01); *H04R 1/08* (2013.01)

(58) Field of Classification Search
CPC ..... H04R 3/06; H04R 19/00; H04R 19/005; H04R 19/016; H04R 19/04
See application file for complete search history.

(56) References Cited

U.S. PATENT DOCUMENTS

2008/0123242 A1* 5/2008 Zhou ..... H01G 5/16 361/290

FOREIGN PATENT DOCUMENTS

CN 101415137 A * 4/2009 ..... H04R 19/005

OTHER PUBLICATIONS

English machine translation of CN101415137A (Zhang Rui, Capacitance Type Microphone, published Apr. 2009) (Year: 2009).*

* cited by examiner

*Primary Examiner* — Mark Fischer
(74) *Attorney, Agent, or Firm* — W&G Law Group

(57) ABSTRACT

A comb-like capacitive microphone includes a substrate penetrated by a cavity having an upper part provided with a step, stationary electrodes equally spaced on the step, and a diaphragm received in the step and including a vibrating portion and a connecting portion connected to the vibrating portion. Movable electrodes protrude from a periphery of the vibrating portion, and an end of the connecting portion away from the vibrating portion is connected to the substrate. The stationary electrodes are arranged in a comb shape and directly etched on the substrate, and the movable electrodes are arranged in a comb shape. The stationary electrodes are spatially separated from the movable electrodes, each stationary electrode is corresponding to each movable electrode. Such structure of the comb-like capacitive microphone offers a relatively large displacement, to decrease the acoustic noise and to offer a high sensitivity, and eventually a sound transducer with high performances.

10 Claims, 9 Drawing Sheets

COMB-LIKE CAPACITIVE MICROPHONE

TECHNICAL FIELD

The present disclosure relates to a capacitive microphone, and in particular, to a comb-like capacitive microphone.

BACKGROUND

With the development of wireless communication, more and more mobile phone are used all over the world. The mobile phones are required not only to have basic function of calling but also to have a high-quality call effect. In particular, with the development of a mobile multimedia technology, the call quality of mobile phones is more important. As a voice collecting device of the mobile phones, the design of microphones of the mobile phones directly affects the call quality.

SUMMARY

The present disclosure provides a comb-like capacitive microphone, and the comb-like capacitive microphone includes: a substrate penetrated through by a cavity, a step being provided on an upper part of the cavity; stationary electrodes equally spaced on the step; and a diaphragm received in the step and including a vibrating portion and a connecting portion connected to the vibrating portion. Movable electrodes protrude from a periphery of the vibrating portion, and an end of the connecting portion away from the vibrating portion is connected to the substrate. The stationary electrodes are arranged in a shape of a comb and directly etched on the substrate, the movable electrodes are arranged in a shape of a comb, the stationary electrodes are spatially separated from the movable electrodes, and one of the stationary electrodes is corresponding to one of the movable electrodes. A projection of the vibrating portion along an axis direction of the cavity covers the cavity.

With such configuration that the projection of the vibrating portion along the axis direction of the cavity covers the cavity, this structure is to be able to control the low-frequency roll-off of the comb-like capacitive microphone by adjusting the gap height and the overlap between the diaphragm and the substrate.

As an improvement, each of the stationary electrodes comprises a first top surface away from the step and a first bottom surface close to the step, and has a first thickness between the first top surface and the first bottom surface; and each of the movable electrodes comprises a second top surface away from the step and a second bottom surface close to the step, and has a second thickness between the second top surface and the second bottom surface.

As an improvement, the substrate is provided with stationary electrode lead-out terminals for energizing the stationary electrodes, and the diaphragm is provided with movable electrode lead-out terminals for energizing the movable electrodes.

As an improvement, the connecting portion comprises a plurality of connecting arms equally dividing the diaphragm, and each of the plurality of connecting arms has a first end fixed to the diaphragm and a second end protruding beyond a peripheral side of the diaphragm.

As an improvement, the plurality of connecting arms comprises four connecting arms.

As an improvement, each of the movable electrode lead-out terminals for energizing the movable electrodes is disposed on one of the plurality of connecting arms.

As an improvement, each of the plurality of connecting arms acts as a mechanical spring.

As an improvement, each of the plurality of connecting arms is at least one of a rectangle arm, a curved arm, or an arm with a triangle shape.

As an improvement, the vibrating portion is in a shape of a centrally symmetric shape.

As an improvement, the centrally symmetric shape is a circle or a square.

In the present disclosure, stationary electrodes are arranged in a comb shape and directly etched on the substrate, and movable electrodes are arranged in a comb shape. With such configuration, the sensitivity of the MEMS transducer can be relatively easily tuned to be increased or decreased depending on the needs by tuning the gap between the combs and the height of the combs; the acoustic noise is reduced with the absence of backplate; the overload pressure point (AOP—Acoustic Overload Point) is improved with the absence of backplate compared to traditional microphone; and the linearity is improved. That is, the sensitivity, loudness, and noise of the capacitive microphone are all improved. Eventually, such structure can produce a sound transducer with higher performances compared to the capacitive microphones in related art.

DESCRIPTION OF REFERENCE NUMERALS

Figure 1:
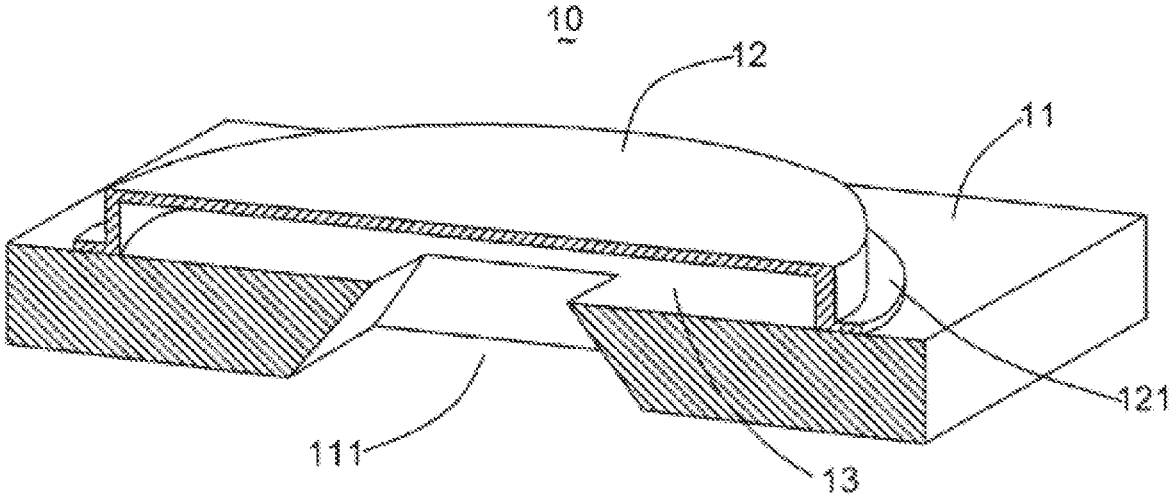
FIG. 1 is a cross-sectional view of a microphone in the related art.
Figure 2:
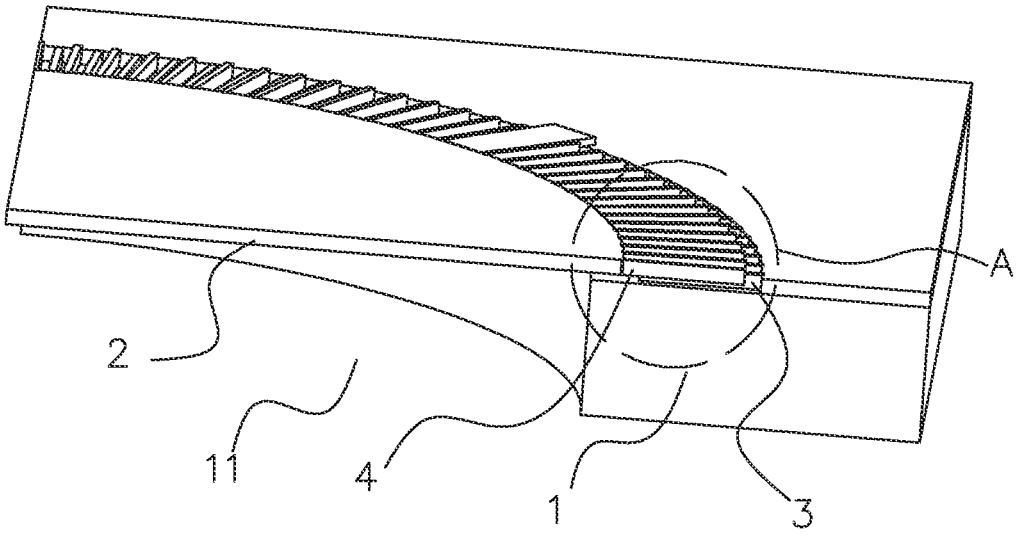
FIG. 2 is an isometric diagram of a partial structure according to the present disclosure.
Figure 3:
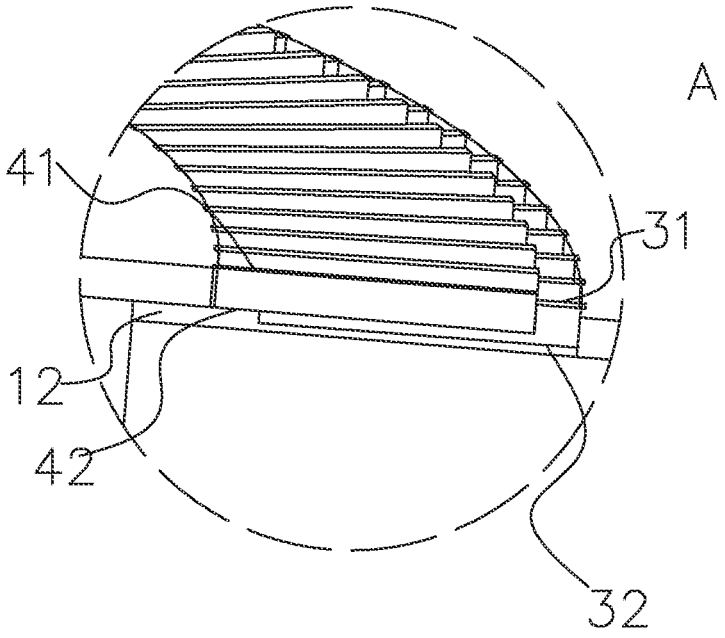
FIG. 3 is an enlarged view of structure in a circle A according to the present disclosure.
Figure 4:
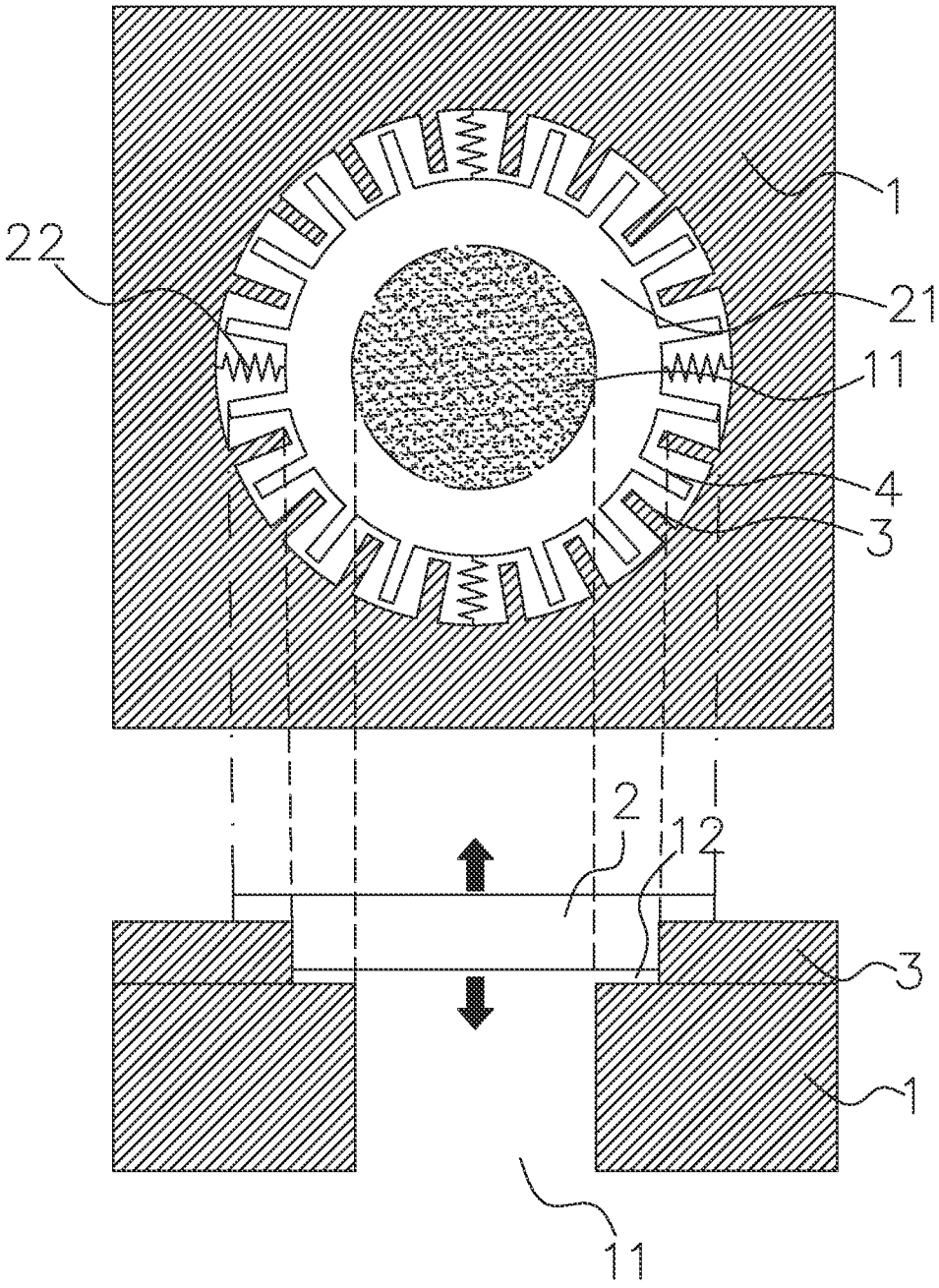
FIG. 4 is a top view of a cross-sectional structure according to the present disclosure.

1: substrate, 11: cavity, 12: step;

2: diaphragm, 21: vibrating portion, 22: connecting portion;

3: stationary electrode, 31: first top surface, 32: first bottom surface;

4: movable electrode, 41: second top surface, 42: second bottom surface.

In the related art,

10: microphone, 11: backplate, 111: sound hole, 12: diaphragm, 121: connecting portion, 13: sound cavity.

DESCRIPTION OF EMBODIMENTS

Embodiments of the present disclosure will be described in detail in the following descriptions, examples of which are shown in the accompanying drawings. The same or similar elements and elements with the same or similar functions are denoted by like reference numerals throughout the descriptions. The embodiments described below with reference to the accompanying drawings are illustrative, and are used only for construing the present disclosure but cannot be construed as limitations on the present disclosure.

In the related art, a Micro-Electro-Mechanical-System Microphone (MEMS Microphone) is now widely used and offers better performances compared to older electret microphones. FIG. 1 is a cross-sectional view of a microphone in the related art. The microphone 10 includes a backplate 11, and a diaphragm 12 opposite to and connected to the backplate 11 through a connecting portion 121. The diaphragm 12 can vibrate up and down relative to the backplate 11. The backplate 11 is further provided with a sound hole 111. The sound hole 111 can transfer a sound airflow to the diaphragm 12 and cause the diaphragm 12 to vibrate. A sound cavity 13 is formed between the diaphragm 12 and the backplate 11. The diaphragm 12 and the backplate 11 are respectively provided with a conductive layer that can be energized, but energized parts are insulated from each other. In this way, the diaphragm 12 and the backplate 11 form a capacitor with its respective capacitance. However, since the value of the capacitance is directly proportional to the common area of two plates of the capacitor and is inversely proportional to a distance between the two plates of the capacitor, the vibration deformation of the microphone diaphragm 12 with this structure is greatly affected by a deformation caused by the interference of electric field force, resulting in that the distance between the diaphragm 12 and the backplate 11 are changed in a curve. Therefore, the capacitive microphone with this structure has a poor linearity, poor sensitivity, and high acoustic noise.

As shown in FIG. 2 to FIG. 5, an embodiment of the present disclosure provides a comb-like capacitive microphone, and the comb-like capacitive microphone includes a substrate 1, stationary electrodes 3, and a diaphragm 2.

The substrate 1 is penetrated by a cavity 11. An upper part of the cavity 11 is provided with a step 12. For example, an inner contour surface of the cavity 11 is a circular structure.

The stationary electrodes 3 are equally spaced on the step 12. In an embodiment, the stationary electrodes 3 are annularly equally spaced with an axis of the cavity 11 as a center, and axis extension lines of the stationary electrodes 3 are concentrated in a center of the cavity 11. The stationary electrodes 3 and the cavity 11 do not cross. The stationary electrodes 3 can be fabricated directly into the single crystalline substrate 1 with a manufacturing process, and can also be a deposited layer such as crystalline silicon deposited by epitaxy process, or polycrystalline silicon.

Figure 5:
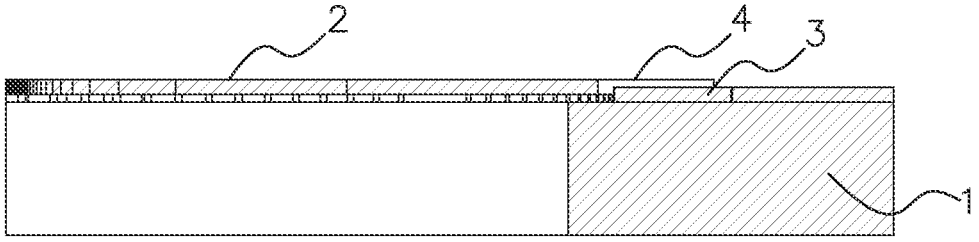
FIG. 5 is a cross-sectional view along line AA'.
Figure 6:
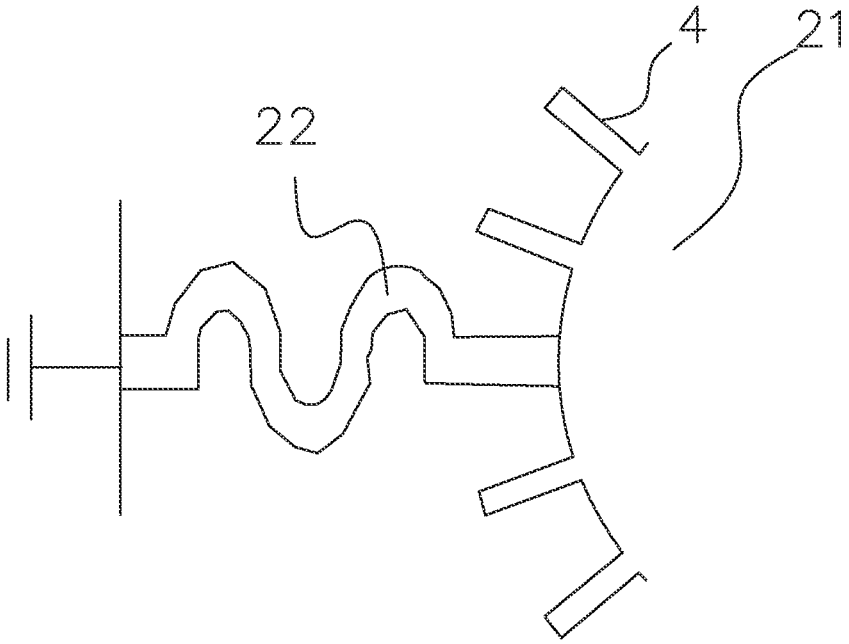
FIG. 6 is a schematic diagram of a connecting portion.
Figure 7:
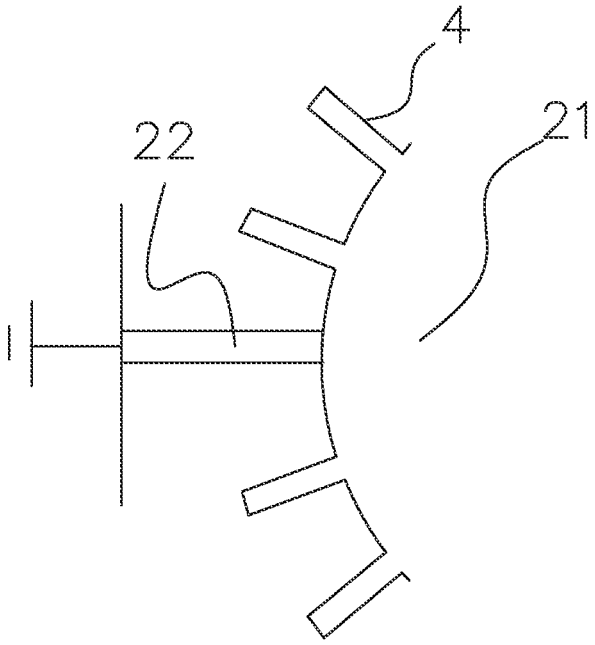
FIG. 7 is another schematic diagram of a connecting portion.
Figure 8:
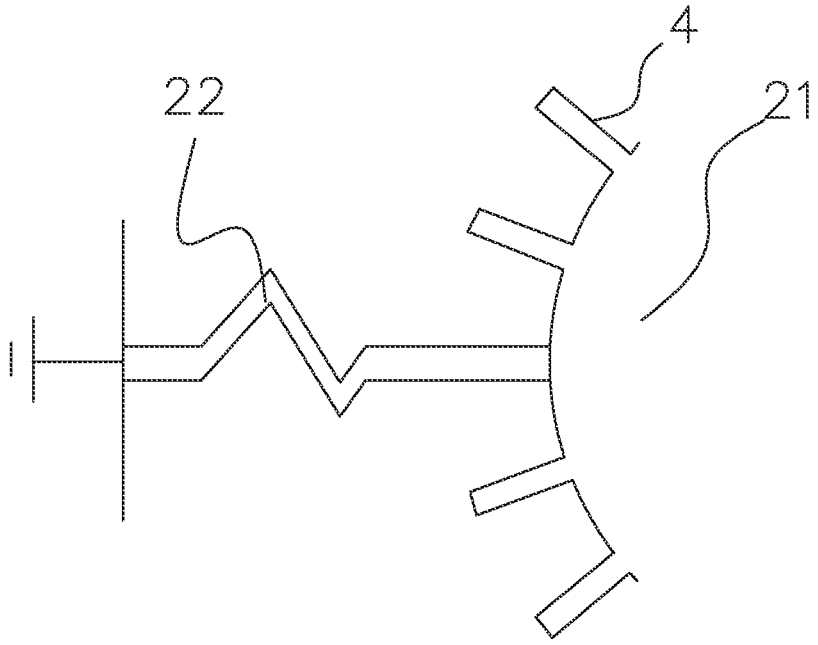
FIG. 8 is another schematic diagram of a connecting portion.
Figure 9:
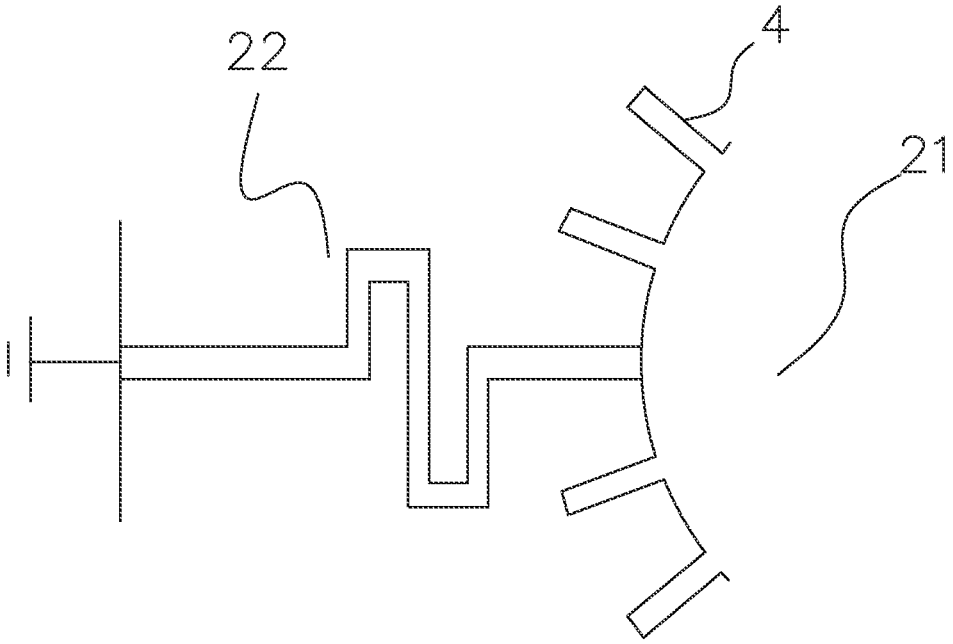
FIG. 9 is another schematic diagram of a connecting portion.

As shown in FIG. 5, the stationary electrodes 3 protrude vertically from the substrate 1 so that the movable electrodes 4 can surround the stationary electrodes 3. Such structure can bring advantages against stiction of the device and increase the capacitance.

The diaphragm 2 is received in the step 12 and includes a vibrating portion 21 and a connecting portion 22 connected to the vibrating portion 21, and movable electrodes 4 protrude from a periphery of the vibrating portion 21. In an embodiment provided by the present disclosure, the vibrating portion 21 is circular, and axis extension lines of the movable electrodes 4 are concentrated in a center of the vibrating portion 21. An end of the connecting portion 22 away from the vibrating portion 21 is connected to the substrate 1. In an embodiment, the end of the connecting portion 22 away from the vibrating portion 21 is connected to the substrate 1 in an elastic connection manner, so that the diaphragm 2 vibrates with the sound wave.

The stationary electrodes 3 are arranged in a shape of a comb and directly etched on the substrate 1, and each stationary electrode 3 is a comb figure of the comb; and the movable electrodes 4 are arranged in a shape of a comb, and each movable electrode 4 is a comb figure of the comb. In other embodiment, the stationary electrodes 3 can be formed by etching from a thick crystalline silicon fabricated by epitaxial silicon growth, or the stationary electrodes 3 of the shape of the comb is formed by deposition of polysilicon directly in pre-formed gap etched in the silicon substrate. The stationary electrodes 3 are spatially separated from the movable electrodes 4, and the stationary electrode 3 and the movable electrode 4 cross and face each other. Dimensions of the stationary electrodes 3 and the movable electrodes 4 define an overlap area. When the diaphragm 2 moves up and down, the overlap area changes and the capacitance of a sensor changes. In this way, a relationship between the capacitance change and an input pressure sound wave actuating the diaphragm 2 can be established. Such structure provides a relatively large displacement, decrease the acoustic noise and can offer a high sensitivity, and eventually a sound transducer with high performances compared to the microphone in the related art.

In an embodiment, a projection of the vibrating portion 21 along an axis direction of the cavity 11 covers the cavity 11, the stationary electrode 3 does not extend to the cavity 11, but sensing occurs on the substrate 1, and the cavity 11 is completely covered by the vibrating portion 21 of the diaphragm 2, thus reducing thermal mechanical noise and reducing the impact of noise. With such configuration, the vibrating portion covering the cavity offers another way to control the low-frequency roll-off of the comb-like capacitive microphone, by adjusting a gap between the vibrating portion and the substrate, and also by adjusting a covering area.

In an embodiment, the stationary electrode 3 includes a first top surface 31 away from the step 12 and a first bottom surface 32 close to the step 12, and has a first thickness between the first top surface 31 and the first bottom surface 32; and the movable electrode 4 includes a second top surface 41 away from the step 12 and a second bottom surface 42 close to the step 12, and has a second thickness between the second top surface 41 and the second bottom surface 42.

The value of the capacitance is directly proportional to the common area of two plates of the capacitor and is inversely proportional to a distance between the two plates of the capacitor, i.e., $C=k\varepsilon_0\varepsilon_r S/d$, k is a constant, $\varepsilon_0$ is a constant, and $\varepsilon_r$ is a constant. After the capacitive microphone is manufactured, the value of $\varepsilon_0\varepsilon_r$ is fixed. S is the common area of the two plates of the capacitor, and d is the distance between the two plates. Therefore, in the capacitive microphone provided in the present disclosure, the stationary electrodes 3 are arranged in a shape of a comb, and the movable electrodes 4 are arranged in a shape of a comb, the stationary electrodes 3 are spatially separated from the movable electrodes 4, and the stationary electrode 3 and the movable electrode 4 cross and face each other. Therefore, after the stationary electrodes 3 and the movable electrodes 4 are energized, the capacitance is formed between the stationary electrodes 3 and the movable electrodes 4, and the distance d therebetween remains unchanged. The area depends on the common area of the first thickness and the second thickness. Therefore, the microphone provided in this embodiment has a good linearity. At the same time, the size of the capacitance is not limited by the size of the diaphragm 2, and thus the structure of the diaphragm 2 can be effectively reduced, which is convenient for miniaturization. The number of masks needed for processing is less and the processing technology is simple. Due to the abandonment of the backplate, the volume of the sound cavity is effectively increased. This embodiment can also eliminate noise interference from transverse perturbations which normally appear between the backplate and the diaphragm in the microphone in the related art.

In an embodiment provided in the present disclosure, the first thickness is equal to the second thickness, which can further improve the performance of the microphone. In another embodiment provided in the present disclosure, the first thickness is different from the second thickness. The thicknesses can be tuned to target the desire performances (either an improved sensitivity, or an improved AOP, or an improved linearity.

In an embodiment, the substrate 1 is provided with stationary electrode lead-out terminals for energizing the stationary electrodes 3, and the connecting portion 22 is provided with movable electrode lead-out terminals for energizing the movable electrodes 4. The electrical lead-out of the movable part and the stationary part are well electrically isolated in order to reduce parasitic capacitances and increase the importance of the desired capacitance at the comb area.

In an embodiment, the connecting portion 22 includes connecting arms equally dividing the diaphragm 2, and the connecting arm includes a first end fixed to the diaphragm 2 and a second end protruding beyond a peripheral side of the diaphragm 2. When the vibrating portion 21 is circular, the connecting arms point to a center of the diaphragm 2. In an embodiment, the connecting portion 22 includes four connecting arms equally dividing the diaphragm 2. Each of the movable electrode lead-out terminals for energizing the movable electrodes 4 is disposed on one of the connecting arms, but the number of the connecting arms is not limited to 4, which can be 2, 5, 6, and the like.

The connecting arm can have various shapes to increase the displacement of the diaphragm 2 while subjected to a sound wave, so as to improve the performance of the microphone. The shape of the connecting arms can be seen from FIG. 6 to FIG. 9. The connecting arm can be, but not limited to, a rectangle arm which can be more or less long and more or less large, or a curved arm, or an arm with a triangle shape, or a combination thereof.

In an embodiment, each connecting arm is a spring. In other embodiment, each connecting arm is a structure acting as a mechanical spring. The springs can be from the same material as the vibrating portion 21 or another material or a stack of materials. It can be single crystalline silicon, silicon nitride, silicon oxide, poly-crystalline silicon, polyimide, or a combination thereof.

In an embodiment provided by the present disclosure, the shape of the vibrating portion 21 of the diaphragm 2 is not limited to a circle, which can also be a square or other centrally symmetric shape.

The vibrating portion 21 of the diaphragm 2 can be made of a single material or a stack of materials. It can be single crystalline silicon, silicon nitride, silicon oxide, poly-crystalline silicon, polyimide, or a combination thereof.

The structure, characteristics, and effects of the present disclosure are described in detail according to the embodiments illustrated. The above are merely some embodiments of the present disclosure. However, the scope of implementation of the present disclosure is not limited by the drawings. Any change made in accordance with the concept of the present disclosure, or equivalent embodiment modified to an equivalent change, when still not exceeding the spirit of the specification and diagrams, shall fall within the protection scope of the present disclosure.

What is claimed is:

1. A comb-like capacitive microphone, comprising:

a substrate penetrated through by a cavity, a step being provided on an upper part of the cavity;

stationary electrodes equally spaced on the step; and a diaphragm received in the step and comprising a vibrating portion and a connecting portion connected to the vibrating portion, movable electrodes protruding from a periphery of the vibrating portion, and an end of the connecting portion away from the vibrating portion being connected to the substrate, wherein the stationary electrodes are arranged in a shape of a comb and directly etched on the substrate, the movable electrodes are arranged in a shape of a comb, the stationary electrodes are spatially separated from the movable electrodes, and one of the stationary electrodes is corresponding to one of the movable electrodes; and a projection of the vibrating portion along an axis direction of the cavity covers the cavity, while the projections of the stationary electrodes do not extend to the cavity.

2. The comb-like capacitive microphone as described in claim 1, wherein each of the stationary electrodes comprises a first top surface away from the step and a first bottom surface close to the step, and has a first thickness between the first top surface and the first bottom surface;

each of the movable electrodes comprises a second top surface away from the step and a second bottom surface close to the step, and has a second thickness between the second top surface and the second bottom surface.

3. The comb-like capacitive microphone as described in claim 2, wherein the substrate is provided with stationary electrode lead-out terminals for energizing the stationary electrodes, and the diaphragm is provided with movable electrode lead-out terminals for energizing the movable electrodes.

4. The comb-like capacitive microphone as described in claim 3, wherein the connecting portion comprises a plurality of connecting arms equally dividing the diaphragm, and each of the plurality of connecting arms has a first end fixed to the diaphragm and a second end protruding beyond a peripheral side of the diaphragm.

5. The comb-like capacitive microphone as described in claim 4, wherein the plurality of connecting arms comprises four connecting arms.

6. The comb-like capacitive microphone as described in claim 4, wherein each of the movable electrode lead-out terminals for energizing the movable electrodes is disposed on one of the plurality of connecting arms.

7. The comb-like capacitive microphone as described in claim 4, wherein each of the plurality of connecting arms acts as a mechanical spring.

8. The comb-like capacitive microphone as described in claim 4, wherein each of the plurality of connecting arms is at least one of a rectangle arm, a curved arm, or an arm with a triangle shape.

9. The comb-like capacitive microphone as described in claim 1, wherein the vibrating portion is in a centrally symmetric shape.

10. The comb-like capacitive microphone as described in claim 9, wherein the centrally symmetric shape is a circle or a square.

* * * * *